US006829969B1

(12) United States Patent
Sullivan

(10) Patent No.: US 6,829,969 B1
(45) Date of Patent: Dec. 14, 2004

(54) SHEET MATERIAL PROCESSING

(76) Inventor: John Anthony Sullivan, Pinfold, Church Lane, Woodford, Stockport, Cheshire SK7 1RQ (GB)

( * ) Notice: Subject to any disclaimer, the term of this patent is extended or adjusted under 35 U.S.C. 154(b) by 0 days.

(21) Appl. No.: 09/936,917

(22) PCT Filed: Mar. 24, 2000

(86) PCT No.: PCT/GB00/01129

§ 371 (c)(1),
(2), (4) Date: Sep. 20, 2001

(87) PCT Pub. No.: WO00/58192

PCT Pub. Date: Oct. 5, 2000

(30) Foreign Application Priority Data

Mar. 31, 1999 (GB) ..... 9901010
Jun. 29, 1999 (GB) ..... 9902040
Jul. 10, 1999 (GB) ..... 9916159

(51) Int. Cl.[7] ..... B65H 5/34

(52) U.S. Cl. ..... 83/298; 83/361; 83/734; 271/265.01; 493/3

(58) Field of Search ..... 83/298, 312, 313, 83/361, 363, 367, 403.1, 416, 436.4, 734; 271/270, 258.01, 265.01, 176, 202; 493/22, 29, 8, 3

(56) References Cited

U.S. PATENT DOCUMENTS 3,907,278 A 9/1975 Jaton ..... 271/94
4,131,273 A 12/1978 Kufrin et al. ..... 271/4
4,267,752 A * 5/1981 Byrt et al. ..... 83/312
4,529,187 A * 7/1985 Einem et al. ..... 271/10.13
4,648,587 A 3/1987 Hiromori et al. ..... 271/12
4,657,236 A 4/1987 Hirakawa et al.
4,781,090 A * 11/1988 Feldkamper et al. ..... 83/312
4,955,265 A * 9/1990 Nakagawa et al. ..... 83/367
5,184,811 A * 2/1993 Sardella et al. ..... 271/118
5,213,036 A 5/1993 Tokuno et al.
5,397,107 A 3/1995 Wolog et al. ..... 271/10
5,765,460 A * 6/1998 Wathieu ..... 83/312
5,899,128 A * 5/1999 Smithe et al. ..... 83/312
6,220,134 B1 * 4/2001 Thiel et al. ..... 83/286

FOREIGN PATENT DOCUMENTS

DE 4329124 3/1995 ..... B65H/3/06
DE 19640963 4/1998 ..... B65H/7/18
EP 0379306 7/1990 ..... B65H/3/02
EP 0414157 12/1991 ..... B65H/3/06
EP 0794140 9/1997 ..... B65H/3/06
GB 0756357 9/1956 ..... 31/1
GB 1385053 2/1975 ..... G05D/13/62
GB 2266517 11/1993
GB 2290074 12/1995 ..... B65H/3/06
WO WO9629269 9/1996 ..... B65H/3/06
WO WO9711017 3/1997 ..... B65H/3/06
WO WO0058190 10/2000 ..... B65H/3/06
WO WO0100514 1/2001 ..... B65H/3/06

* cited by examiner

*Primary Examiner*—Stephen Choi
(74) *Attorney, Agent, or Firm*—Bracewell & Patterson, L.L.P.

(57) ABSTRACT

A feed mechanism sheet material sequentially on demand to a take-up mechanism of processing machinery. The feed mechanism has a feed table with a gate. Sheets may be stacked against the gate, which allows only the lowermost sheet to pass therebeneath. Rollers within the surface of the rotatably driven to advance the lowermost sheet beneath the gate to the take-up mechanism. A restraining device prevents freewheeling over run of the rollers. The sheets may be longer in length than the circumference of a tool-carrying roll set used to process the sheet. The difference is accommodated by transferring sheet feed through the nip between the tool set and a separate servo-controlled drive upstream of the nip.

34 Claims, 5 Drawing Sheets

SHEET MATERIAL PROCESSING

This invention concerns apparatus use in the processing of sheet material, particularly, though by no means exclusively, of corrugated Board or card as used in the box and carton making industries.

One aspect of the present invention is concerned with the control of sheet material feed upstream of, and through, the nip between rotating rolls provided with one or more sheet-treatment tooling sets for effecting cutting, printing, creasing and/or scoring etc of the sheet material. In conventional sheet processing machinery, sheet material feed through the nip is imparted by the rotating rolls via tool-sheet engagement and, when the tooling is disengaged from the sheet, via traction belts or the like provided on the rolls. This necessarily imposes limitations on the variety of blank sizes that can be catered for.

According to one aspect of the present invention there is provided apparatus for processing sheet material comprising; a set of rotatable rolls provided with one or more sheet-processing tools for engagement with the sheet material in the nip zone between the roll set; a first drive for rotating the roll set; a second drive upstream of the nip zone for effecting feed of the sheet material; and means operable to co-ordinate operation of the second drive with rotation of the roll set in such a way that sheet feed through the nip zone is effected in part by the roll set and in part by the second drive.

Various features of this aspect of the invention including a related method are the subject of claims appended to this specification.

Another aspect of the invention is concerned with the feed of sheet material to processing machinery in which stacked sheets are placed on a feed table against a gate which allows only the lowermost sheet to pass therebeneath to be taken into the nip of take-up rolls. In known equipment, this may be effected under the action of a reciprocating vacuum suction cup, feed rollers or a kicker mechanism. Such feeding arrangements must be controlled with great precision and even then misfeeds are a not uncommon experience. One solution to these problems is proposed in my British Patent No. 2 274 276, but this involves reciprocating movement of the entire roller bed, which is not energy efficient and places certain restrictions on sheet size.

According to a second aspect of the present invention there is provided for apparatus for feeding sheet material sequentially on demand to take up mechanism of sheet processing machinery, said apparatus comprising a feed surface having a gate and upon which the sheets may be stacked against the gate which allows only the lowermost sheet to pass therebeneath, conveyor means (such as a bed of rollers or a conveyor belt) associated with the feed surface for advancing the lowermost sheet beneath the gate to the take-up mechanism, means to allow the conveyor means to free-wheel once the lowermost sheet is being advanced thereover by said take-up mechanism, and means for restraining freewheeling feed of the next lowermost sheet after the sheet being fed has cleared the conveyor means.

In one embodiment, such freewheeling feed by the conveyor means may be restrained by some form of braking means acting on the next lowermost sheet, e.g. vacuum suction means behind the rollers to hold the next lowermost sheet against the action of the free-wheeling rollers after the sheet being fed has passed under the gate.

In another embodiment, such freewheeling feed by the conveyor means may be restrained by braking means acting on the conveyor means.

The take-up mechanism may comprise take-up rolls.

The conveyor means may comprise rollers fitted with sprag clutches and may advance the sheet being fed at substantially the same speed as or, more preferably, a slower speed than, that of the take-up mechanism.

Vacuum suction may be applied from beneath the conveyor means to pull the lowermost sheet downwardly thereagainst.

A further aspect of the invention is concerned with ensuring that feed of the sheet material is in proper registry with the sheet-treatment machinery.

To this end prior known sheet feeding apparatus has relied upon the leading edge of each sheet being at a defined position at the commencement of feed. Many factors, including premature movement of a sheet by continuing rotation of feed rollers after the previously fed sheet has cleared them, mechanical tolerances, improper stacking of the sheets on the feed table, sheet quality and even atmospheric conditions can cause the leading edge of a sheet to be displaced from the expected defined position at the commencement of feed.

According to a third aspect of the present invention there is provided apparatus for feeding sheet material sequentially on demand to take-up mechanism of sheet processing machinery, said apparatus comprising a feed table having a gate and upon which sheets may be stacked against the gate which allows only the lowermost sheet to pass therebeneath, means driven by a servo-motor to advance the lowermost sheet beneath the gate to the take-up mechanism, a sensing means between the gate and the take-up mechanism to detect the passage of a datum position of the sheet, a microprocessor which receives data indicating the position of the take-up mechanism and from the sensing means and programmed to control the servo-motor to ensure that the sheet presents itself to the take-up mechanism at the correct instant.

The datum on the sheet may be constituted by the leading edge of the sheet or some other suitably positioned mark on the sheet, e.g. printing previously applied to the sheet, a cut-out in the sheet or a print registration mark on the sheet. Prior to sheet treatment involving cutting and/or creasing for instance, it is common practice to apply printing to the sheet for product identification and/or advertising purposes and the subsequent sheet treatment has to be accurately registered with such printing. If the location of the printing is accurately positioned with the leading edge of the sheet and if the leading edge of the sheet has not been damaged in any way, then the leading edge may be used as the datum. However, if print position in relation to the leading edge is not consistent and/or if there is a possibility of the leading edge being damaged, then use of the printing itself as the datum source is to be preferred so that proper registry between the machinery tooling and the printed areas can be secured. Where the datum is derived from pre-applied printing on the sheet, it may be constituted for example by the a leading extremity of a selected part of the printed area.

The microprocessor may also be programmed to ensure that the sheet, or at least the leading edge thereof, presents itself to the take-up mechanism at a desired speed.

The desired speed may be substantially the same as but preferably is slightly less than the speed at which the take-up mechanism forwards the sheet. The desired speed may be substantially zero.

In this aspect of the invention, the take-up mechanism may comprise a pair of take-up rolls or gripper bars and the means driven by the servo-motor may comprise a bed of rollers within the surface of the table which are rotatably driven to advance the lowermost sheet beneath the gate to the take-up mechanism and means to allow the rollers to free-wheel once the lowermost sheet is being advanced thereover by the take-up mechanism.

According to yet another aspect of the present invention there is provided apparatus for feeding sheet material sequentially on demand to take-up mechanism of sheet processing machinery, said apparatus comprising a servo-drive motor, means for transmitting drive from the servo-drive motor to the sheet material to advance the sheet material to the take-up mechanism, sensing means for detecting the passage of a datum position of the sheet material as the latter advances towards the take-up mechanism, and a microprocessor which receives data indicating the position of the take-up mechanism and from the sensing means and programmed to control the servo-drive motor to secure registration between the sheet material and the take-up mechanism, the drive transmitting means being operable automatically in a freewheel mode while in engagement with sheet material travelling at a speed greater than the speed of the servo-drive motor.

These and various other aspects and features of the invention will be further apparent from the following description with reference to the figures of the accompanying drawings, in which.

Figure 1:
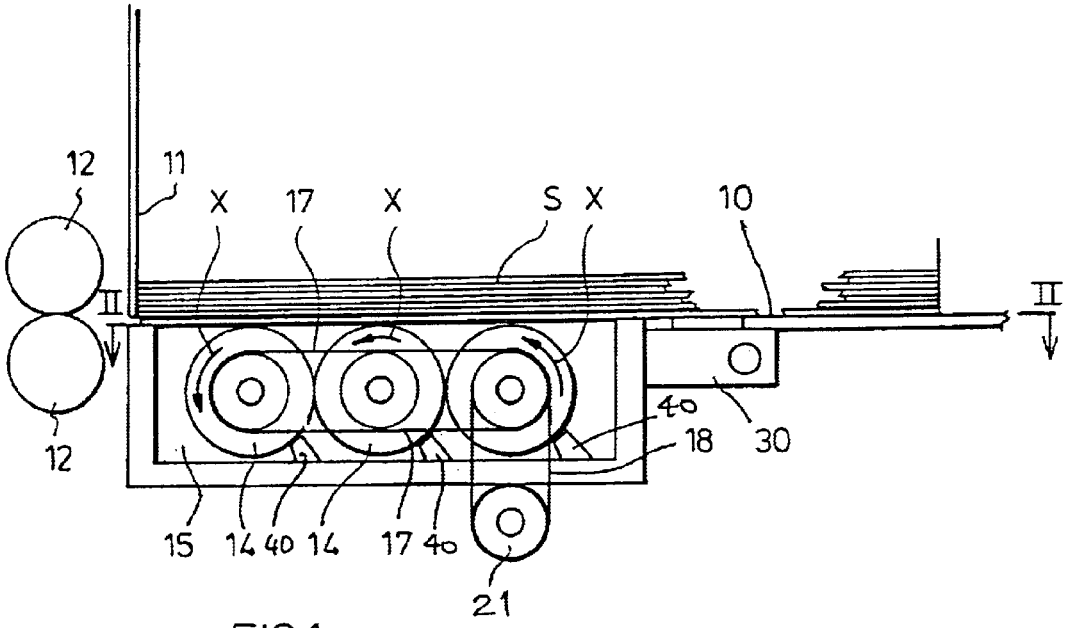
FIG. 1 shows a side elevation of a first form of feed apparatus.
Figure 2:
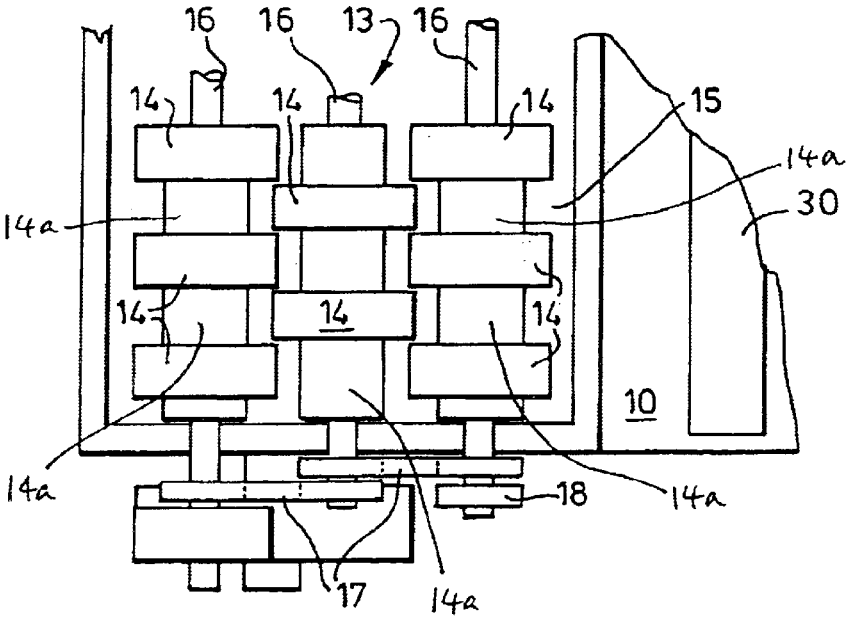
FIG. 2 shows a cross-section through the apparatus on the line II—II of FIG. 1.

Referring now to FIGS. 1 and 2 it will be seen that the apparatus comprises a feed table 10 upon which a stack of sheets S may be placed against a gate 11 beneath which only the lowermost sheet in the stack may pass. Successive sheets are advanced beneath the gate 11 into the nip of take-up rolls 12 by a bed 13 of rollers 14 within the surface of the table. The take-up rolls 12 comprise an upper roll provided with tooling for appropriate treatment of the board, e.g. die cutting, slotting, creasing etc., and a lower roll which is also driven and may be provided with a layer of resiliently deformable material such as polyurethane, or contra tooling to the other roll, for engagement with the sheets as they travel through the nip between the rolls.

The rollers 14 are mounted within a chamber 15 to which vacuum suction is applied to pull the lowermost sheet downwardly thereagainst. The rollers 14 advance the lowermost sheet by being rotatably driven as indicated by the arrows X at a speed equal to or less than the speed of the take-up rolls 12. Once the advance of sheet is under the control of the rolls 12, the rollers 14 by virtue of having sprag clutches between their inner peripheries and their drive shafts 16 are arranged to free-wheel if the speed imparted to the sheet by the rolls exceeds that of the rollers 14. At this stage, the drive to the rollers 14 may be reduced or arrested altogether according to circumstances. Under these conditions, the rollers 14 simply rotate by virtue of their contact with the sheet material as driven by the roll set 12.

At least during this free-wheeling stage forward drive to the rollers 14 may be arrested and a vacuum chamber 30 behind the rollers 14 is exhausted to hold the next lowermost sheet in a fixed position against the action of the free-wheeling rollers after the sheet being fed has passed under the gate 11 to leave an opening through which the next sheet could otherwise prematurely pass. The chamber 30 can be exhausted continuously or cyclically.

The drive shafts 16 are rotatably interconnected by timing drive belts 17 and one shaft is driven by a timing belt 18 itself driven intermittently in a forward direction only by a servo-electric motor 21 which may stop whilst a sheet is being advanced by the take-up rolls 12 and which operates at a timed sequence demanded by the processing machinery.

In FIG. 2, the rollers 14 associated with each drive shaft 16 are separated by spacing portions 14*a* which may be rotatably fast with the rollers. Adjacent sets of rollers staggered; however, in a modification the rollers in adjacent sets (and the spacing portions between them) may be aligned rather than staggered.

Figure 3:
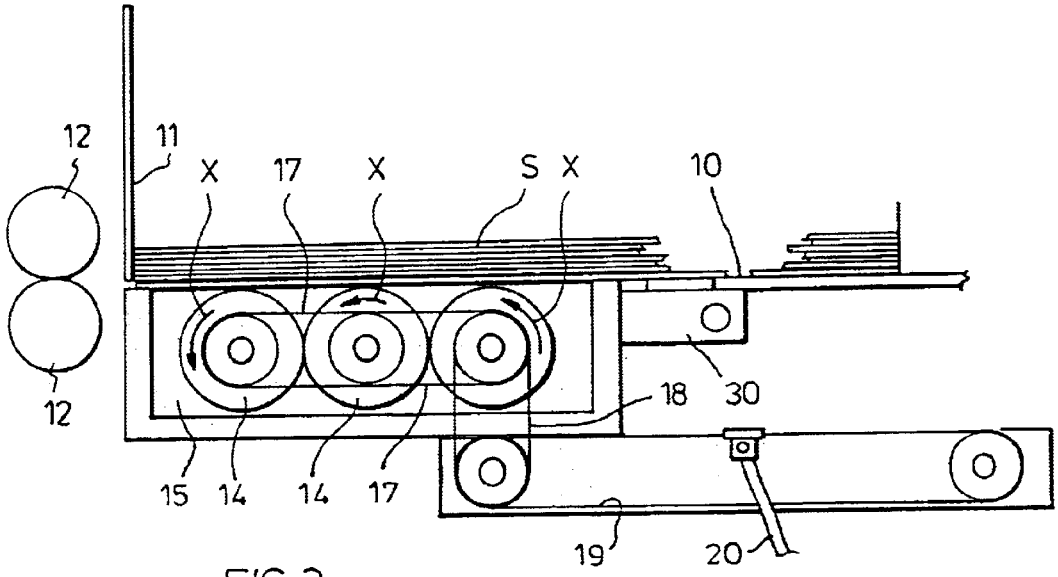
FIG. 3 shows a side elevation of a second form of feed apparatus.

The arrangement of FIG. 3 is generally similar, like parts being indicated by like reference numerals. In this embodiment, however, the timing belt 18 is driven by a timing belt 19 reciprocated by an arm 20 operating in time with the processing machinery. Thus the shafts 16 of the rollers 14 are driven in reverse direction during the time that the rollers 14 are free-wheeling. Drive mechanisms other than those shown in FIGS. 1 to 3 are possible, such as from a reciprocating cam imitating the movement of the arm 20 of FIG. 3.

Referring back to FIG. 1, the restraint provided by the vacuum chamber 30 to prevent misfeed of the next lowermost sheet may be supplemented by brake means for damping rotation of rollers 14 so that once the sheet being fed has clears each set of freewheeling rollers, their rotation is rapidly arrested to prevent any premature advance of the next lowermost sheet in the stack. The brake means 40 may comprise any suitable mechanism to arrest the rollers once they are no longer driven by their engagement with the sheet being fed. For instance, the brake means 40 may comprise friction pads or more elaborate mechanically, electrically or pneumatically operable means for resisting rotation of the rollers 14. In one embodiment of the invention, the brake means may be arranged to constantly bear against the rollers or a component which rotates with the rollers when the latter are driven or when they freewheel. In this instance, the contacting surfaces may be provided with material such as a PTFE which has sufficiently low friction to reduce wear while affording sufficient braking to prevent freewheeling once the rollers when this could otherwise affect accurate positioning of the blanks. More specifically, after the departing sheet has cleared the rollers 14, the latter are required to be substantially static with respect to the next sheet to be fed so that that sheet is not advanced by an indeterminate amount (thereby causing misregistration) as could otherwise happen if the rollers 14 are allowed to over run upon disengagement with the previously fed sheet. The rollers 14 remain static until driven by the servomotor 21 when feed of the next sheet is required.

In one implementation of the braking means, the roller arrangement of FIG. 2 is modified in the manner previously described where the rollers 14 and the spacing portions 14*a* are aligned instead of being staggered, and the braking means comprises one or more arms (not illustrated in FIG. 2) which each bridge and constantly bear against a respective set of aligned spacing portions 14*a* to arrest freewheeling thereof as soon as the rollers 14 are no longer driven by the sheet material.

In a further modification, the vacuum chamber 30 may be dispensed with altogether and the necessary restraint to prevent misfeed of the next lowermost sheet by the freewheeling rollers may be provided solely by damping the freewheeling rollers 14, e.g. by means of the brake means 40.

Figure 4:
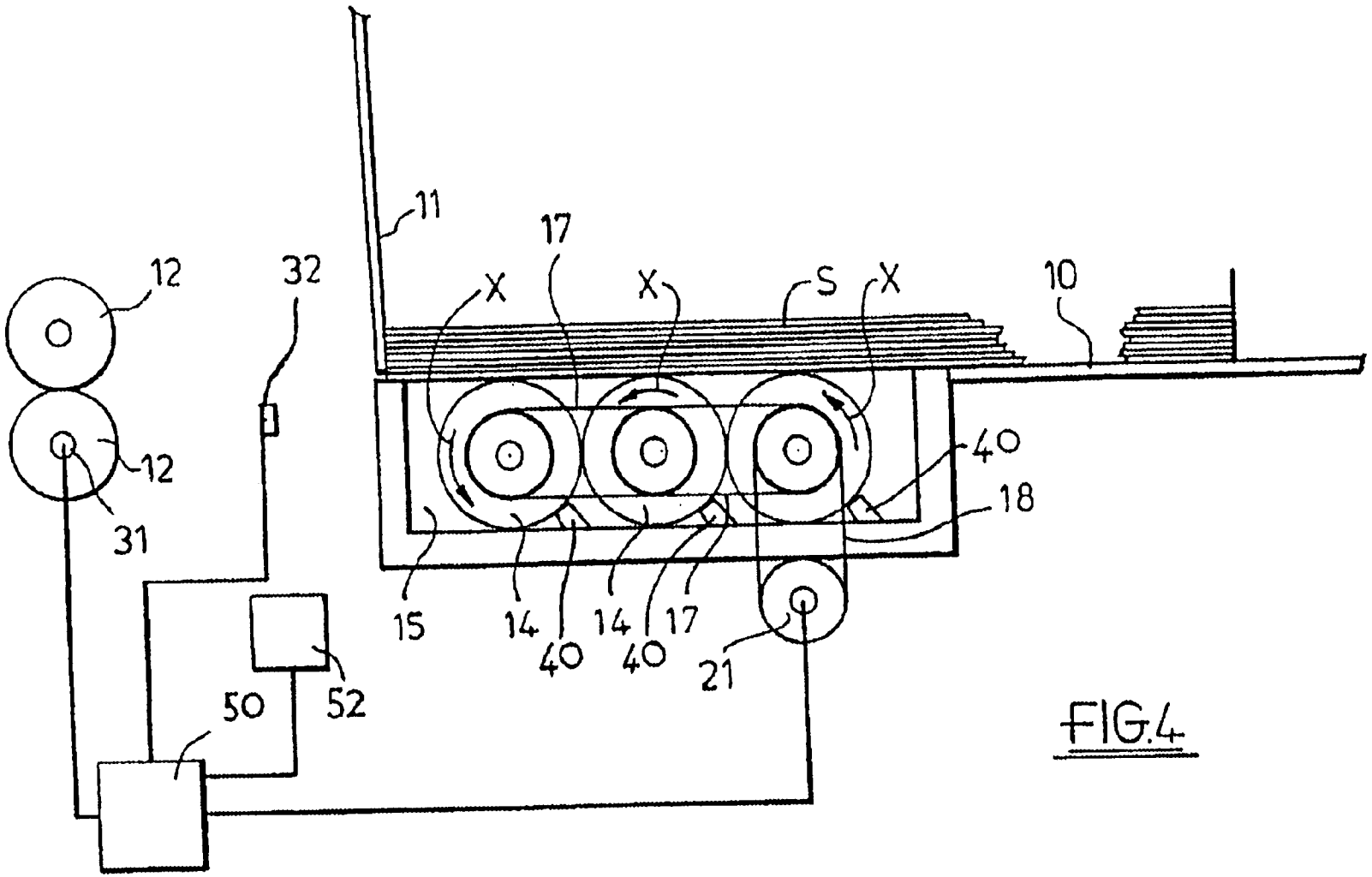
FIG. 4 is a view similar to that of FIG. 1 showing a modified embodiment having a servo-drive for controlling positioning of the sheets.

In the embodiments thus far described, misfeed through overrun of the freewheeling rollers is managed by braking the rollers and/or by braking the next lowermost sheet to be fed from the stack. FIG. 4 shows another approach which can be used instead of, or together with, sheet or roller braking as described above. Those parts in FIG. 4 having counterparts in FIGS. 1 and 2 are depicted by the same reference numerals and, insofar as they function in the same way as in the embodiment of FIGS. 1 and 2, will not be described in detail below.

In the embodiment of FIG. 4, the drive to the shafts 16 and hence the rollers 14 is provided by a servo-electric motor 21 which is operable to drive the rollers to effect forward feed of the sheets, one by one, to the rolls 12 but stops whilst a sheet is being advanced by the rolls 12, operation of the motor 21 being in a timed sequence demanded by the processing machinery. The servo-motor 21 is controlled by a microprocessor 50 which receives data from a pulsed shaft encoder 31 indicating the rotational position of the take-up rolls 12 and also from a sensing means comprising for example a high speed fibre optic sensor 32 located between the gate 11 and take-up rolls 12.

The sensor 32 is arranged to detect passage of a datum on the sheet being fed, e.g. the leading edge of the sheet, a cut-out or a preselected printed mark on the sheet. Where the sensor detects a preselected printed mark, this may be specifically provided for the purpose during a preceding step of the sheet treatment process, e.g. on a section of the sheet which is to removed during die cutting, or it may be constituted by a specific sensor-identifiable location of a pre-printed area, e.g. an image or such like, on the sheet.

The microprocessor 50 is programmed to control the servo-motor 21 to ensure that the sheet, e.g. the leading edge of the sheet, presents itself at the nip between the rolls 12 at precisely the correct instant and at a desired speed. It will be understood that the exact position of the leading edge or other datum of any sheet at the commencement of feed is immaterial since any variation is detected by the sensor and microprocessor 50 and can be compensated for by appropriate control of the servo-drive by the microprocessor to effect registry of the tooling on roll set 12 with the desired position on the blank.

Although in the embodiment of FIG. 4, misfeed of the lowermost sheet can be compensated for by the sensor and servo-drive arrangement, the vacuum chamber 30 (not shown in FIG. 4) and/or the brake means 40 of the embodiment of FIGS. 1 and 2 may be incorporated to enhance control of sheet feed, thereby reducing the amount of correction which might otherwise be required by the microprocessor and servo-drive.

The sensor and servo-drive control arrangement of FIG. 4 may also be used in conjunction with a take-up mechanism in the form of gripper bars, in which event the microprocessor may be programmed to present the sheet, e.g. the leading edge thereof, to the gripper bars at the correct instant but at zero speed.

We have found that the use of a servo-drive, as in the embodiment of FIG. 4, affords the potential for significantly greater flexibility in the range of sheet or board sizes that can be handled by the sheet treatment machinery in that a given arrangement of tooling on the rolls 12 may be used for cutting, printing, creasing or scoring discrete blanks of sheet material which differ substantially in length and in particular blanks that may be longer than the circumference of the tool-carrying roll set. In the following description, for simplicity the tools will be referred to as slotting tools; however, they may equally be other types of tool such as sheet creasing tools.

Figure 5:
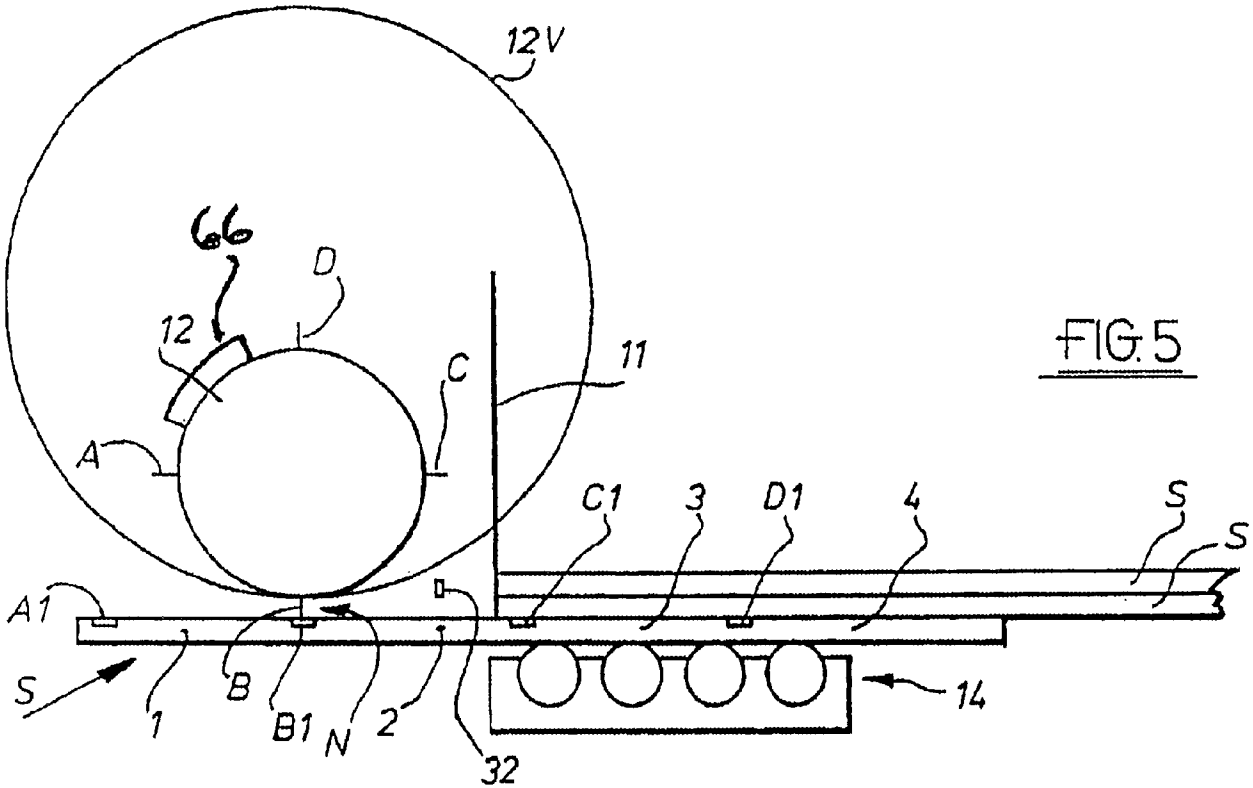
FIG. 5 is a diagrammatic view of another embodiment of the invention in which sheet feed is shared between a servo-drive of the form illustrated in FIG. 4 and the tool-carrying rolls for processing the sheet.

Referring to FIG. 5, the smaller circle depicts the actual circumference of the upper roll 12 which is shown with four sets of tooling A, B, C and D, e.g. slotting tools, disposed at different locations around its periphery. Upstream of the rolls 12, a feeder as described with reference to FIG. 4 is provided. Only feed rollers 14 are illustrated for simplicity.

The tools A, B,C and D are illustrated as being equispaced around the circumference of roll 12 but this is purely by way of example and is not essential. The sheets S are fed to the nip N by the rollers 14 from right to left as arrowed and pass through the nip N between the upper and lower rolls 12 (the lower roll 12 being unshown in FIG. 5) where contact is made with the tools as the rolls rotate and the board progresses through the nip. It will be understood that the rollers 14 act as means for transmitting drive from the servomotor 21 (see FIG. 4) to the sheets but, under conditions where under the control of the roll set 12 the sheet is travelling at a speed greater than the speed of rollers 14 at that instant, the latter freewheel while remaining in contact with the sheet being fed. Once the sheet being processed by the roll set 12 clears one or more of the rollers however, braking of the roller or rollers no longer in contact with the sheet occurs so that freewheeling is arrested substantially instantaneously.

The sheet in FIG. 5 is intended to be processed by the rolls in such a way as to slot the sheet at locations A1, B1, C1 and D1 which are spaced apart by distances corresponding to the spacings between the tools A, B, C and D. The sheet may therefore progress through the nip at substantially the same speed as the peripheral speed of the rolls 12. As illustrated, the slot at location A1 has already been produced and that portion of the sheet has advanced beyond the nip N. The slot B1 is in the process of production. Slots at locations C1 and D1 have yet to be produced. The slots A1, B1, C1 and D1 demarcate successive panels 1, 2, 3 and 4 and typically are each 400 mm in length, i.e. corresponding to a circumferential separation of 400 mm between the tools carried by upper roll 12.

In accordance with one of the aspects of the present invention, the sheet drive located upstream of the nip N is arranged to sheet feed not only to the nip but also participates in sheet feed through the nip, the arrangement being such that sheet feed through the nip is only effected by rolls 12 primarily when one of the tools engages the sheet; at other times, except for the trailing section of the sheet (as described further below), sheet feed through the nip is effected by the upstream sheet drive. A feature of this aspect of the invention is the capability of transferring sheet drive between the servomotor 21 and the roll set 12 while the sheet is travelling through the nip. In this regard, in contrast with conventional roll sets which are provided with sheet traction sections for driving the sheet when not engaged with the tooling, an embodiment in accordance with this aspect of the invention need not, at least not for the major length of the sheet, incorporate such sheet traction sections in addition to the tooling.

For a given production run, the rolls 12 will normally rotate at constant peripheral speed with the consequence that each tool will, in the direction of sheet travel, have a well-defined linear velocity the instant it registers with the dead centre position of the nip N. In practice, each tool will initially engage with the sheet at a location slightly upstream of the nip N and finally disengage from the sheet at a location slightly downstream of the nip, the precise points of tool-sheet engagement and disengagement being dependent upon factors such as the radial extension of the tooling and the thickness of the sheet material. Except for the trailing section of the sheet, in the embodiment of FIG. 5 the sheet is fed through the nip N by the servomotor 21 (via rollers 14) during those phases of the treatment cycle when the tooling is not engaged with the sheet. To achieve this, the microcontroller 50 is programmed to regulate the servomotor speed. Through monitoring of the positional information derived from the encoder 31 and the sensor 32 coupled with information relating to the configuration of treatment operations to be performed on the sheet by the tooling, the microcontroller 50 serves to co-ordinate operation of the servomotor 21 with the roll set 12 in such a way the equipment is capable of handling a wide range of sheet lengths including lengths which signficantly exceed the circumference of the tool-carrying roll.

Thus, in the case of the sheet undergoing slotting in FIG. 5, the servomotor 21 will be effective to drive the sheet through the nip N in such a way that the slots B1, C1 and D1 are created at predetermined locations relative to the slot A1 by feeding the sheet through a distance equivalent to the distance between the tool-sheet disengagement and tool-sheet engagement.

Figure 6:
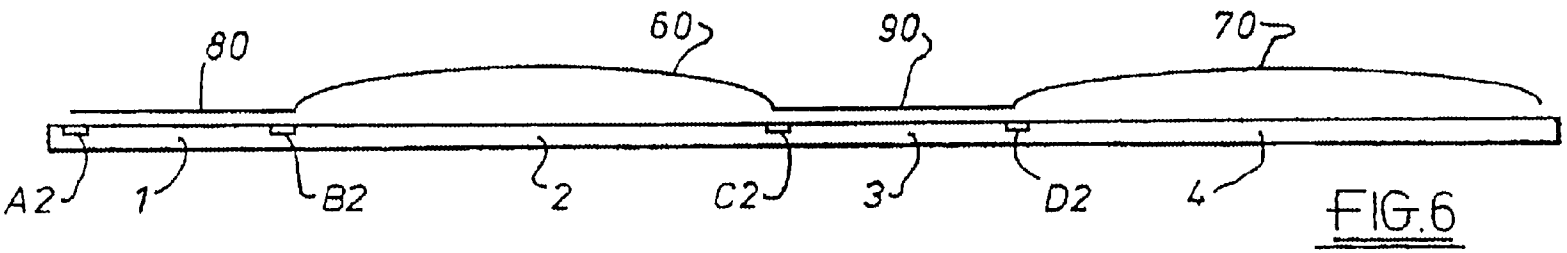
FIG. 6 is a schematic view of a longer sheet than that shown in FIG. 5.

Because sheet feed through the nip N is primarily under the control of the servo-drive rather than the rolls 12, it is possible to cater for different cutting regimes using a roll set 12 of given circumferential dimensions. For example, FIG. 6 shows a longer sheet size which is intended to be slotted at locations A2, B2, C2 and D2. Purely by way of example, panels 1 and 3 of the sheet illustrated in FIG. 6 may have the same dimension (in the feed direction) as panels 1 and 3 in FIG. 5, e.g. 400 mm. However, panels 2 and 4 may be different, e.g. 1100 mm in length. The slotting configuration of the sheet in FIG. 6 can be achieved using the same set of rolls 12 as used to produce the slotting configuration of FIG. 5 by pre-programming the microprocessor with appropriate data relating to the FIG. 6 configuration so that, during passage of those sheet lengths corresponding to panels 2 and 4 through the nip N, the sheet is accelerated by the servo-drive/rollers 14 to a speed significantly greater than the tangential speed of the rolls 12 thereby compensating for the fact that the spacing between the slotting tools is less than the length of sheet to be left untreated between successive tool operations thereon.

In effect, the upper roll 12 will at times be equivalent to a virtual roll, depicted diagrammatically in FIG. 5 by the circle referenced 12V, of much greater diameter than the actual roll 12. One possible speed profile imparted to the sheet is indicated diagrammatically in FIG. 6. Thus, curves 60 and 70 represent the increased speed profile for sheet feed as the panels 2 and 4 are fed through the nip N while lines 80 and 90 represent those intervals during which sheet feed is substantially the same as the tangential speed of the rolls 12.

It will be appreciated that when one or more of the panels is required to be shorter than the circumferential spacing between successive tools, the microcontroller (having been primed with the relevant information relating to panel sizes) is programmed to control the servo-drive in such a way that the sheet speed profile during travel through the nip is adapted to compensate for the fact that the sheet is required to travel a shorter distance compared with the circumferential spacing between successive tools. The speed profile may for instance involve a dwell period in which the sheet is stationary.

In practice, irrespective of the lengths of the panel sections relative to the circumferential spacings of the tools, the speed profile for servo-driven feed of the sheet may be such that each time a tool approaches the sheet, the sheet speed is travelling at a speed greater than the roll speed but is progressively reduced to so that the sheet speed is marginally slower (typically by a factor of up to 5%, e.g. 2 to 3%) than roll speed immediately prior to transfer of drive from the servomotor to the rolls 12. This allows the freewheel action to come into play thereby compensating for any line speed differential between the servo-drive 21 and the rolls and substantially reducing or eliminating any tendency for the sheet material to scuff or scrub the polyurethane surface of the lower roll which would thereby necessitate frequent replacement of the polyurethane. The instant that drive transfer from the servomotor 21 to the rolls 12 occurs, the tooling will be travelling faster than the sheet. The rollers 14 are thus caused to freewheel and will, in effect, turn through a well-defined angular distance corresponding to the length of sheet fed while the sheet is being driven by the rolls 12. At this time, the microcontroller may be programmed to slow down the servomotor or even stop it altogether. As the point of tool-sheet disenagement approaches, the microcontroller causes the servomotor speed to increase again so that, at the point of tool-sheet engagement, the servomotor speed is substantially matched with the roll speed to effect smooth transfer of sheet feed back to the servomotor. To compensate for any line speed differential at the time of tool-sheet disengagement, the microcontroller may control the servomotor speed so that it is slightly slower than the tool speed immediately prior to such disengagement thereby allowing the freewheel action to effect such compensation.

During the time that there is tool-sheet engagement, the rollers 14 will be freewheeling. The braking applied to the rollers 14 is designed prevent any tendency for over run to occur due to inertia at the time of transfer of drive back to the servomotor, which could otherwise result in the sheet getting out of registration with the tooling.

If the sensor 32 is arranged to detect only one datum position on the sheet (e.g. the leading edge or a predetermined point in a printed image), the braking action exerted on the freewheeling rollers 14 is particularly important to prevent misregistration between the sheet passing through the nip and the tooling. However, the sensor 32 may be arranged to detect a number of strategically located datum positions on the sheet and feed back the information to the microcontroller so that, if any misregistration develops, this can be compensated for by appropriate control of the servomotor 21. In this case, the braking action is of lesser significance but may nevertheless be of advantage in limiting the extent of any misregistration that might otherwise occur through inertia-created over run of the rollers 14 when in freewheeling mode.

After the final tool disengages the sheet during treatment of a particular sheet, sheet drive is transferred back to the servomotor. However, because there is necessarily a gap between the rollers 14 and the nip N, the rollers will not be capable of completing drive of the sheet through the nip. This may be catered for either by transfer of the sheet to a further drive downstream of the nip, i.e. to drive the trailing section of the sheet through the nip, or by providing the roll set with a strategically located traction section 66 (see FIG. 5). Where a further drive is provided downstream for this purpose, it may comprise a bed of rollers generally similar to the bed 13 of rollers 14 provided upstream of the nip N. In this event, the further set of rollers may be driven in exact synchronism with the upstream set of rollers, e.g. by using the same servo-drive 21 to drive both sets of rollers.

It will be understood that, for a given roll set and tooling arrangement, wide variations in sheet slotting (or printing/creasing/scoring) configuration and sheet length may be catered for by appropriate programming of the microcontroller. Thus, in practice, once the microprocessor has been programmed for a number of predetermined slotting configurations, the process may be carried out simply by inputting, for a given run, the particular slotting configuration required and the required dimensions. Thus, a user entry input 52 (see FIG. 4) may be provided for entry of the relevant data into the microcontroller 50. User input may be menu driven; for instance, there may be a dislay monitor on which the selected slotting configuration is displayed with an invitation for the user to key in dimensions for each panel section.

The precise points of drive transfer from the rolls 12 to the servomotor 21 and vice versa may not be accurately predictable in advance because of variations in sheet thickness, humidity conditions, radial tool dimensions and settings etc. In order to cater for this, the microcontroller may be programmed to accept user-entered adjustments to allow such variations to be compensated for. For example, after the microcontroller has been set up for a particular run, the operator may check the slotted sheets produced and, in the event of any offset from the desired slotting locations, may key in an adjustment via the input 52 so that the microcontroller can modify the sheet drive appropriately to remove the offset. This may be an interative process in practice—i.e. a number of samples may be checked with corresponding modification of the offset keyed into the microcontroller until the offset has been reduced or eliminated.

During the course of a given production run, the roll speed will normally be substantially constant; however the drive to the rolls 12 may be a variable speed drive so that roll speed may be increased or reduced for different productions runs (or even in the course of a particular production run). This allows greater flexibility in the lengths of sheet that can be handled. For instance, in the case of sheet which is to be produced with very large untreated panel sections, it may be desirable to operate at a lower roll speed (or even zero roll speed) while the tooling is out of engagement with the sheet material so as to afford more time for feed of long sections of the sheet by the servo-controlled drive.

For the avoidance of doubt, as used herein, except where the context admits otherwise, references to the roll set speed, the speed of the rollers 14 and the speed of the servomotor are to be construed in terms of the speed of travel of the sheet.

Although the invention is described above with reference primarily to the treatment of blanks of sheet material, the possibility is not excluded of feeding a continuous web of material to the rolls 12 and controlling web passage through the nip in the manner described above. Thus, for example, the rolls 12 may include tooling for severing, e.g. by cross-cutting, the continuous web fed thereto into discrete sheets of length up to or exceeding the circumference of the tool-carrying roll or rolls. In addition to the severing tool, the rolls 12 may be provided with one or more circumferentially spaced tools for performing other operations on the web.

In a modification applicable to the various embodiments illustrated in the drawings, the bed of rollers 14 may be replaced by a vacuum transfer-type conveyor belt assembly in which one or more endless belts are entrained around a pair of rollers driven by the servo-drive motor, with the sheet material being supported and advanced by the upper run(s) of the belt(s) and optionally drawn into engagement with the upper run(s) by a vacuum produced beneath the upper run(s). In this arrangement, the belt(s) may be arranged to freewheel when the line speed of the sheet material is greater than the speed of the servo-drive motor and brake means may also be included to prevent over run of the freewheeling action. The freewheel action may be provided for by a suitable clutch arrangement between the servo-drive motor and one or more of the rollers of the conveyor belt, the arrangement being such that the conveyor belt assembly functions in substantially the same fashion as described in relation to the rollers 14 in each of the illustrated embodiments.

Figure 7:
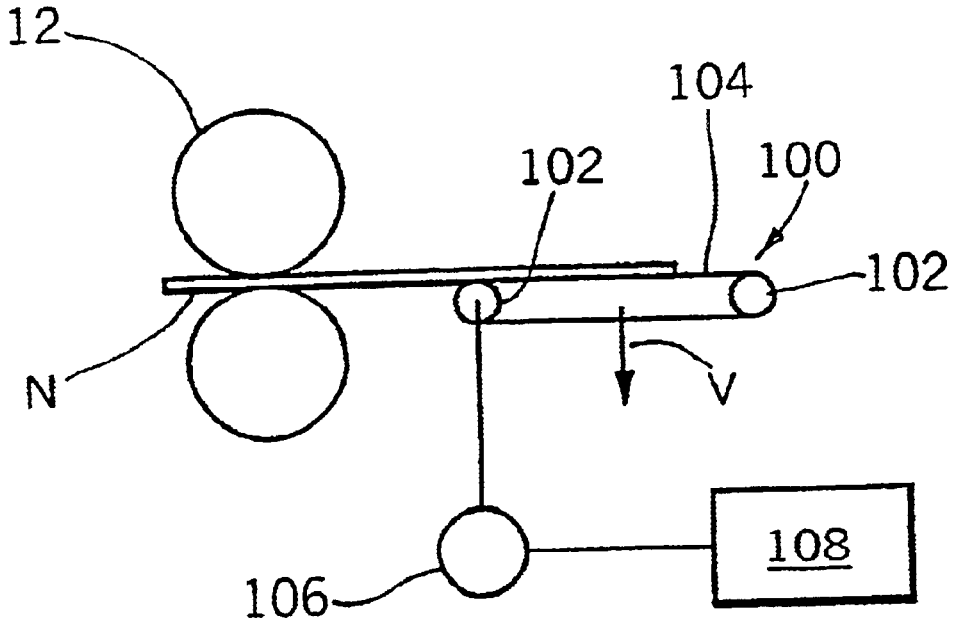
FIG. 7 is a schematic view of another embodiment of drive transmission for controlling advance of the sheet material towards and through the nip of the tool-carrying rolls.

Referring to FIG. 7, the tool-carrying roll set 12 may be as described in relation to the other illustrated embodiments. Instead of being preceded by the bed of rollers 14, the roll set in this case is preceded by a conveyor belt assembly comprising endless belts 100 entrained around rollers 102 so that the upper runs 104 form part of the sheet material support surface upstream of the nip N. Rollers 102 at the forward end of the conveyor belt are driven by servo-drive motor 106 under the control of the microprocessor 108 which receives positional data from a shaft encoder associated with the roll set 12 for registration purposes.

Though not shown, there will be a gate associated with the forward end of the conveyor belt assembly for ensuring that the sheets are released one at a time for advance towards the nip. Also, a sensor may be provided for detecting a datum position on the sheet to facilitate correct registration with the roll set, the sensor being linked to the microprocessor 108 to allow any correction to be made via the servo-drive motor and the conveyor assembly. A vacuum is drawn through the upper run (as depicted by arrow V) to hold down the sheet on to the conveyor assembly.

Initially the sheet is driven by the conveyor assembly to the nip N where the drive through the nip is then handled in part by the tooling carried by the roll set and in part by the servo-drive and conveyor belt assembly. As in the embodiment of FIG. 5, the freewheeling action together with appropriate control, by the microprocessor 108, of the servo-drive motor speed serves to compensate for any line speed differential between the servo-drive motor 106 and the roll set 12 during transfer of sheet drive between the two. Also the servo-drive motor 106 is controlled by the microprocessor 108 so as to regulate drive of the sheet (when not driven by the roll set) in accordance with the predetermined configurations to be cut, creased, printed etc. by the roll set.

It will be appreciated that it is not intended to limit the invention to the above embodiments example only, many variations, such as might readily occur to one skilled in the art, being possible, without departing from the scope thereof as defined by the appended claims.

What is claimed is:

1. Apparatus for processing sheet material, comprising: a take-up mechanism of sheet processing machinery, a feed table having a gate and upon which sheets may be stacked against the gate which allows only the lowermost sheet to pass therebeneath, a drive transmitting arrangement driven by a servo-motor to advance the lowermost sheet beneath the gate to the take-up mechanism, a sensing means between the gate and the take-up mechanism to detect the passage of a datum position of the sheet, and a microprocessor which receives data indicating the position of the take-up mechanism and from the sensing means and which is programmed to control the servo-motor to ensure that the sheet presents itself to the take-up mechanism at the correct instant, such that, when the take-up mechanism commences to feed the sheet, the drive transmitting arrangement operates automatically in a freewheel mode while in engagement with the sheet, said apparatus further including restraining means for restraining feed of the next lowermost sheet by overrun of the freewheeling drive transmitting arrangement after the sheet being fed has cleared said drive-transmitting arrangement.

2. Apparatus according to claim 1 wherein the microprocessor is programmed to ensure that the leading edge of the sheet presents itself to the take-up mechanism at a desired speed.

3. Apparatus according to claim 2 wherein the desired speed is slightly less than the speed at which the take-up mechanism forwards the sheet.

4. Apparatus according to claim 2 wherein the desired speed is zero.

5. Apparatus according to claim 1 wherein the take-up mechanism comprises a pair of take-up rolls.

6. Apparatus as claimed in claim 5 in which the take-up rolls are provided with two or more circumferentially spaced sheet-processing tools.

7. Apparatus as claimed in claim 6 in which the take-up rolls are provided with a traction section trailing one of the tools for imparting feed motion to the sheet material subsequent to disengagement between said one tool and the sheet.

8. Apparatus according to claim 5 in which said rolls are provided with one or more sets of sheet-processing tooling for engagement with, and for imparting drive to, the sheet material in the nip zone between the roll set and further comprising a first drive for rotating the roll set so that the sheet material is driven through the nip while engaged by at least one of the sets of tooling, a second drive including said servomotor upstream of the nip zone for effecting feed of the sheet material, and means operable to co-ordinate operation of the second drive with rotation of the roll set in such a way that sheet feed through and beyond the nip zone is effected in part by the roll set and in part by the second drive.

9. Apparatus as claimed in claim 8 in which the feed of sheet material through the nip zone is effected by the roll set at least while there is tool-sheet engagement.

10. Apparatus as claimed in claim 8 in which feed of sheet material through the nip zone is effected by the second drive at least for part of the time that there is no tool-sheet engagement.

11. Apparatus as claimed in claim 8 in which the second drive is a variable speed drive operable to vary the speed profile of sheet material feed through the nip zone.

12. Apparatus as claimed in claim 8 in which, during roll driven sheet material feed, the second drive is arrested or operates at a reduced drive speed compared with the roll-drive speed.

13. Apparatus as claimed in claim 8 in which, immediately prior to transfer of sheet material feed from the second drive to the roll set or vice versa, the second drive is programmed to run at a speed which is reduced compared with the roll speed.

14. Apparatus as claimed in claim 8 in which, during the interval leading up to transfer of sheet material feed from the second drive to the roll set or vice versa, the second drive operates in a mode in which its speed exceeds the roll speed and is then adjusted to a lower speed.

15. Apparatus as claimed in claim 14 in which said lower speed is less than the roll speed.

16. Apparatus as claimed in claim 8 in which the co-ordinating means is programmable in dependence upon the configuration of tool operations to be performed on the sheet.

17. Apparatus as claimed in claim 8 in which the sheet material is fed to the roll set as discrete blanks.

18. Apparatus as claimed in claim 1 wherein the restraining means comprises braking means for braking or damping freewheeling of said drive transmitting arrangement so that freewheeling is arrested substantially immediately upon disengagement of the sheet from the drive transmitting arrangement.

19. Apparatus as claimed in claim 1 in which the drive transmitting arrangement comprises rollers which engage the sheet material.

20. Apparatus as claimed in claim 1 in which the drive transmitting arrangement driven by the servo-motor comprises a bed of rollers within the surface of the table which may be rotatably driven to advance the lowermost sheet beneath the gate to the take-up mechanism.

21. Apparatus as claimed in claim 20 in which the restraining means comprises brake means acting on the rollers.

22. Apparatus according to claim 20 in which the take-up mechanism comprises a tool-carrying roll set.

23. Apparatus according to claim 20 wherein the rollers are rotatably interconnected by timing drive belt means, one of which rollers is driven by a further timing drive belt.

24. Apparatus as claimed in claim 1 in which the drive transmitting arrangement driven by the servo motor comprises conveyor means associated with the feed table for advancing the lowermost sheet beneath the gate to the take-up mechanism.

25. Apparatus as claimed in claim 24 in which the conveyor means comprises roller means which directly engage with the lowermost sheet.

26. Apparatus as claimed in claim 24 in which the conveyor means comprises roller means which contact the lowermost sheet indirectly through one or more conveyor belts entrained around the roller means.

27. Apparatus as claimed in claim 24 in which the restraining means comprises vacuum suction means located upstream of the conveyor means to hold the next lowermost sheet against the action of the freewheeling rollers after the sheet being fed has passed under the gate.

28. Apparatus according to claim 24 in which the conveyor means is fitted with sprag clutches and advance the sheet being fed at substantially the same speed as, or a slower speed than that of, the take-up mechanism.

29. Apparatus according to claim 24 in which the conveyor means is driven by a servo motor which alternately drives the rollers forwardly and stops.

30. Apparatus according to claim 24 wherein vacuum suction is applied from beneath the conveyor means to pull the lowermost sheet downwardly against the rollers.

31. An apparatus for feeding sheet material on demand to a take-up mechanism of sheet processing machinery, comprising:

a feed table having a gate and upon which sheets may be stacked against the gate which allows only the lowermost sheet to pass therebeneath;

a drive mechanism driven by a servo-motor to advance the lowermost sheet beneath the gate to the take-up mechanism;

a sensor adapted to be located between the gate and the take-up mechanism that detects the passage of a datum position of the sheet;

a microprocessor that is adapted to receive data indicating the position of the take-up mechanism and data from the sensor and which controls the servo-motor to ensure that the sheet presents itself to the take-up mechanism at the correct instant; and wherein the drive mechanism automatically operates in a freewheel mode while still in engagement with the sheet at the same time the take-up mechanism commences to feed the sheet, the drive mechanism ceasing freewheel rotation once the sheet has cleared the drive mechanism.

32. The apparatus according to claim 31, further comprising:

a brake incorporated with the drive mechanism that stops the freewheeling movement of the drive mechanism after the sheet being fed has cleared the drive mechanism.

33. The apparatus according to claim 31, further comprising:

a vacuum suction device upstream of the drive mechanism for holding the next lowermost sheet against the action of the freewheeling movement of the drive mechanism after the sheet being fed has passed under the gate.

34. An apparatus for processing sheet material, comprising:

a take-up roller set that is operable at a selected continuous speed;

a feed table having a gate and upon which sheets may be stacked against the gate which allows only the lowermost sheet to pass therebeneath;

a drive roller set driven by a servo-motor to advance the lowermost sheet beneath the gate to the take-up roller set;

a sensor located between the gate and the take-up roller set that detects the passage of a datum position of the lowermost sheet;

a microprocessor that receives data indicating the rotational position of the take-up roller set and data from the sensor and which causes the servo-motor to intermittingly rotate the drive roller set to present the lowermost sheet to the take-up roller set at the correct instant;

the drive roller set automatically operating in a freewheel mode while still in engagement with the lowermost sheet at the time the take-up roller set commences to engage the lowermost sheet; and a brake that engages the drive roller set to restrain the freewheeling movement of the drive roller set after the lowermost sheet has cleared the drive roller set.

* * * * *